US005534674A

United States Patent [19]

Steffens

[11] Patent Number: 5,534,674

[45] Date of Patent: Jul. 9, 1996

[54] CURRENT LIMITING CONTACT SYSTEM FOR CIRCUIT BREAKERS

[75] Inventor: Wilhelm Steffens, Sankt Augustin, Germany

[73] Assignee: Klöckner-Moeller GmbH, Bonn, Germany

[21] Appl. No.: 333,548

[22] Filed: Nov. 2, 1994

[30] Foreign Application Priority Data

Nov. 2, 1993 [DE] Germany ..... 43 37 344.5

[51] Int. Cl.[6] ..... H01H 3/46; H01H 77/10

[52] U.S. Cl. ..... 218/154; 200/401; 335/191

[58] Field of Search ..... 218/1, 7, 146, 218/153, 152, 154; 200/400, 401; 335/16, 147, 185, 187, 189, 191, 192, 194, 195; 74/2

[56] References Cited

U.S. PATENT DOCUMENTS

| | | | |
|---|---|---|---|
| 2,447,137 | 8/1948 | Runke | 74/2 X |
| 3,728,508 | 4/1973 | Netzel | 218/7 |
| 4,336,516 | 6/1982 | Bratkowski et al. | 335/171 |
| 4,380,785 | 4/1983 | DeMeyer et al. | 361/96 |
| 4,484,164 | 11/1984 | McClellan et al. | 335/16 |
| 4,678,873 | 7/1987 | Preuss et al. | 200/18 |
| 4,695,913 | 9/1987 | Terracol et al. | 361/13 |
| 4,750,375 | 6/1988 | Godesa | 74/2 |
| 4,891,618 | 1/1990 | Paton | 335/95 |
| 5,223,681 | 6/1993 | Buehler et al. | 218/22 |
| 5,231,365 | 7/1993 | Kato | 335/132 |
| 5,260,533 | 11/1993 | Livesey et al. | 200/401 |
| 5,270,564 | 12/1993 | Parks et al. | 200/401 |
| 5,278,373 | 1/1994 | Faber et al. | 200/401 |

FOREIGN PATENT DOCUMENTS

| | | |
|---|---|---|
| 0353948 | 2/1990 | European Pat. Off. . |
| 0127737 | 8/1979 | Germany . |
| 3133285 | 3/1983 | Germany . |
| 3411276 | 10/1984 | Germany . |
| 3729745 | 3/1988 | Germany . |
| 3901852 | 7/1990 | Germany . |
| 4000206 | 4/1991 | Germany . |
| 0962819 | 7/1964 | United Kingdom . |

*Primary Examiner*—J. R. Scott
*Attorney, Agent, or Firm*—Nils H. Ljungman and Associates

[57] ABSTRACT

A current limiting contact system for a circuit breaker with improved durability and a reliable electrodynamic contact system opening. The moveable contact is composed of several contact fingers with a moveable contact piece. Each contact finger is mounted at one end by a swivel pin and connected at the other end to the selector shaft by a toggle system which is acted upon by a contact force spring. On the swivel pin side of a phase connector, tabs are configured. The tabs, when lateral contact pressure is applied, produce the sole electrical connection with the contact fingers. The force effect of the contact force spring is translated into an obtuse angle, in the "ON" state, to the contact finger. During electrodynamic opening, the relevant contact finger tips into a stable position. The wear on the contact pieces is counteracted by increasing contact pressure force up to the maximum travel. The contact system for limiting short circuit currents is suitable for multi pole circuit breakers.

20 Claims, 8 Drawing Sheets

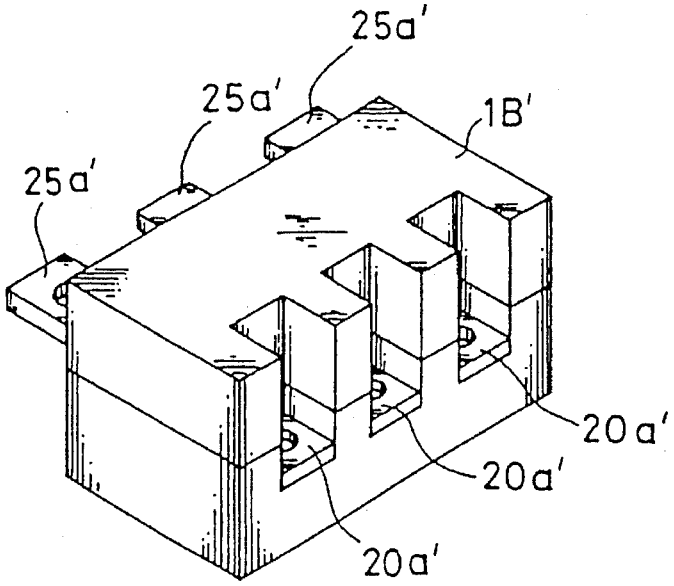
Fig.11
Fig.12
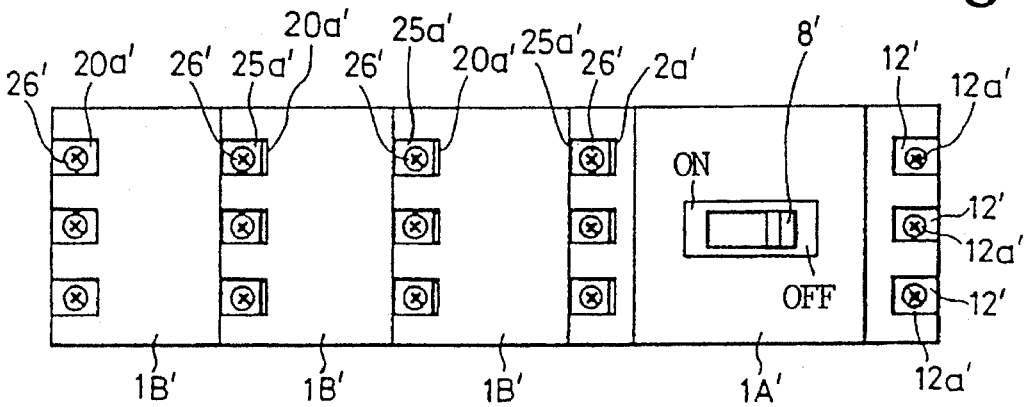
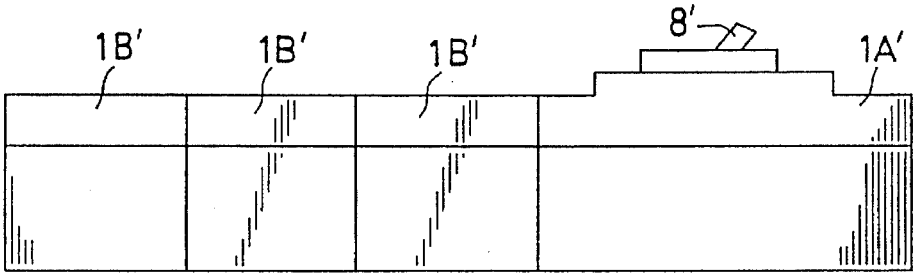
Fig.13

CURRENT LIMITING CONTACT SYSTEM FOR CIRCUIT BREAKERS

BACKGROUND OF THE INVENTION

1. Field of the Invention

The present invention generally relates to current limiting contact systems which are typically used in circuit breakers. In particular, the present invention relates to a contact system, which contact system is composed of several parallel contact fingers for each pole to be switched and each pole to be protected, and, when there is a short circuit, limits the short circuit current by means of electrodynamic opening, until the breaker mechanism is tripped.

2. Background Information

A three-phase circuit breaker with a contact system of the type described above is disclosed in European Patent Application No. 353 948 A2. Three contact systems are arranged next to one another in a molded housing. Each contact system is composed of a stationary contact with a stationary contact piece, and a moveable contact with moveable contact pieces. Each stationary contact leads into a first phase connector. The moveable contact is composed of several contact fingers arranged parallel to one another, each with a moveable contact piece. The contact fingers are mounted on an axle, and each contact finger is connected by means of a V-shaped, flexible connection lead to the connection lead. The connection leads are connected to a second phase connector.

Each contact finger is acted upon by a helical compression spring, which compression spring is braced against a contact carrier. The contact carrier grips longitudinally in a U-shape around the contact fingers, and the axle of the contact fingers is mounted in the contact carrier. The contact fingers are mounted on a transverse selector shaft by means of a swivel pin. Each contact carrier is acted upon by a cam-operated toggle mechanism. In addition, two helical tension springs serve as energy stores or energy storage mechanisms, and engage between the swivel pin and the axles of cam follower rollers, which cam follower rollers are mounted in a linked manner in the switch axle. The central moveable contact is additionally connected to the toggle system of a breaker mechanism via the selector shaft by means of lateral supports. The necessary contact pressure force between the moveable contact pieces and the stationary contact piece is produced by the helical compression springs. During tripping or manual shutting off by means of the breaker mechanism, essentially all moveable contacts are swivelled by their spring-activated coupling with the toggle spring mechanism over the selector shaft, in order to open the contact pieces.

In case of extreme short circuiting, the electrodynamic repulsive forces caused by the short circuit current flowing in the V-shaped connecting leads, as well as the high current density on the contact pieces, exceed the contact compression force which leads to spinning off of the moveable contact concerned. The toggle spring mechanism then falls into its second stable tilted position. This tilted position is maintained until the circuit breaker is opened by the subsequent tripping breaker mechanism in all phases. The arc occurring between the separated contact pieces is extinguished with additional arcing contacts and an arcing chamber. Elastic stops are housed in the molded housing, which on the one hand collect the high kinetic energy of the electrodynamically spun-off contact concerned, and on the other hand tilt this contact back into the first stable position after tripping of the breaker mechanism.

The disadvantages of the contact system described above are, on the one hand, the complex means for the conductive connection between the contact fingers and the second phase connector the complex means; for the production of the necessary contact compression force the complex means; and for the collection of the kinetic energy of the spun-off contact; and, on the other hand, the considerable number of elements which are necessary for transferring movement from the breaker mechanism to the moveable contact. A further, crucial disadvantage is that with increased wear of the contacts, in particular by burning, the contact compression forces diminish, leading to an increasing degradation of the switching properties.

In German Patent Application No. 31 33 285 C2 an automatic circuit breaker is disclosed. This automatic circuit breaker includes a moveable contact carrier mounted in a fixed pivot, which moveable contact carrier can be operated by means of a breaker mechanism and is latched separately from the breaker mechanism by a locking lever. Thus, during rapid opening by means of a striker on the moveable contact carrier, a tension lever is moveable with respect to the contact compression force and thus the latch on the contact carrier is released. As such, the free ends of the locking lever and of the tension lever, which are mounted in the fixed pivot and which guide a compression spring, are joined together in an articulated manner, and support a sliding roller in the region of the articulated joint. The moveable contact carrier is provided with an essentially kidney-shaped slide plate in the direction of the switching operation, which slide plate forms a slip-in guide for the spring-tensioned sliding roller. A projection provided on the sliding plate in the proximity of the lock forms, together with the sliding part, a latching point. The angle of rotation of the tension lever is approximately the same as that of an angle of opening of the moveable contact carrier limited by a stop.

Apart from the fact that, in German Patent Application No. 31 33 285 C2, only a single finger contact system is described, this contact piece has disadvantages in that separate means are required to limit the opening movement caused by the short circuit as well as for collecting the kinetic energy occurring therewith, and that, with increasing wear of the contacts, the contact compression forces diminish.

OBJECT OF THE INVENTION

The object of the present invention is therefore to provide improved durability and reliable electrodynamic opening of the contact system at low cost.

SUMMARY OF THE INVENTION

Proceeding from a contact system of the type described further above, the problems associated with known contact systems can preferably be solved by a combination of the following features, in relation to each of the contact fingers:

the second phase connector can preferably lead or extend into a tab which tab, at least in part, by surrounding the swivel pin when contact pressure is applied, can preferably be in lateral contact with the contact finger;

between the selector shaft and the contact finger an over-extendable toggle system can preferably be arranged, which toggle system can be acted upon by a contact force spring connected by one end to the selector shaft;

the spring force components acting upon the internal toggle connection of the toggle system exerted by the other end of the contact force spring, in the electrodynamically non-activated state of the contact finger, preferably form an obtuse angle (alpha) with the working axis of the toggle element connected to the contact finger; and the movement of the toggle system is preferably limited in the direction of the travel of the moveable contact piece.

The direct electrical connection between the contact fingers and the tabs of the second phase connector effected by lateral pressure can be produced simply, and is essentially not affected by mechanical forces which typically occur with known flexible connection leads. Using the contact finger, the toggle system, and the contact force spring, an essentially simple, yet effective toggle mechanism, preferably independent from the other contact fingers, can be achieved. With such a configuration, on the one hand, the necessary contact compression force can be produced, which force preferably increases as the contact pieces degrade as a result of wear within the useful travel, whereby the diminishing conductivity can thus be equalized in an advantageous manner on the touching surfaces of the pairs of contact pieces. On the other hand, the toggle mechanism can effect the individual reliable electrodynamic opening of the pair of contact pieces in which, because of the amount of the short circuit current flowing, the energy of the high current density is typically sufficient to overcome the contact compression force. As such, it is essentially not necessary to provide means connected to the molded housing for collecting the kinetic energy of the electrodynamically "spun off" contact finger, as this energy can preferably be collected by the contact system itself.

Furthermore, an essentially simple, direct, active connection between the breaker mechanism and selector shaft can be provided. An essential point, with respect to the contact force springs, concerns neither the construction nor the direction of application of the spring force, preferably since the toggle mechanism can be adapted to the type of contact force springs used by a person having routine technical skill.

The relationship between the contact compression forces and the frictional forces to be overcome on the toggle system can preferably be aided by the generally L-shaped configuration of the contact fingers. The bending away on the swivel pin side of the contact fingers is advantageous for the spatial accommodation of the contact force springs, as well as for the relative movement of the contact pieces. In other words, and in accordance with one embodiment of the present invention, the ends of the contact fingers adjacent the swivel pin can be configured as "elbows" or alternatively, bent portions to preferably provide a more compact construction and to allow for the movement of the contact fingers. With the contact fingers configured as substantially parallel contact strips preferably disposed at a distance from one another, in particular when the contact strips are mechanically pre-tensioned, the conductive connection between the second phase connector and the contact fingers can be particularly easy and effectively produced. Further, the known spring elements, for example disc springs, the common swivel pin, and the U-shaped spring clip, can also serve this purpose. The making of the toggle system, preferably by using a link slider and a rod, represents a particularly advantageous embodiment of the present invention.

By means of an essentially simple rearrangement, a corresponding toggle mechanism can also be configured with a helical tension spring. The common retaining plate and the retaining clip can be, particularly with integral connection to the spring clip, advantageous means for coupling the moveable contact onto the selector shaft. The first pin and the supporting plate, particularly when they are integrally configured from the retaining plate, and the second pin and the supporting shoulders, are embodiments which can be used individually or commonly, with respect to an advantageous configuration of the elements of the toggle mechanism directly connected to the link.

The bilateral limitation of movement by the link slider can have advantages in the assembly of the contact system. The U-shaped link, in the outer arms of which the rod can preferably be inserted, is essentially easy to produce, and is also low-friction and particularly effective. The outer arms of the U-shaped link can preferably be in the form of two substantially parallel lugs. The circular, arc-shaped configuration of the rod can preferably provide for a space-saving construction of the contact system with large opening extension of the electrodynamically opened pairs of contact pieces.

An additional embodiment of the toggle system with two toggles represents a further possibility for producing the toggle mechanism, wherein the two toggles are preferably joined with their free ends between the selector shaft and the contact finger, and on or with the inner articulated connection of which the contact force spring is gripped.

When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention will now be explained in more detail with reference to the accompanying drawings, in which:

FIG. 11 is a perspective view showing the current limiting unit shown in FIG. 9;

FIG. 12 is a plan view showing a current limiting circuit breaker with three current limiting units; and FIG. 13 is a side view showing the current limiting circuit breaker of FIG. 12.

DESCRIPTION OF THE PREFERRED EMBODIMENT

Figure 1:
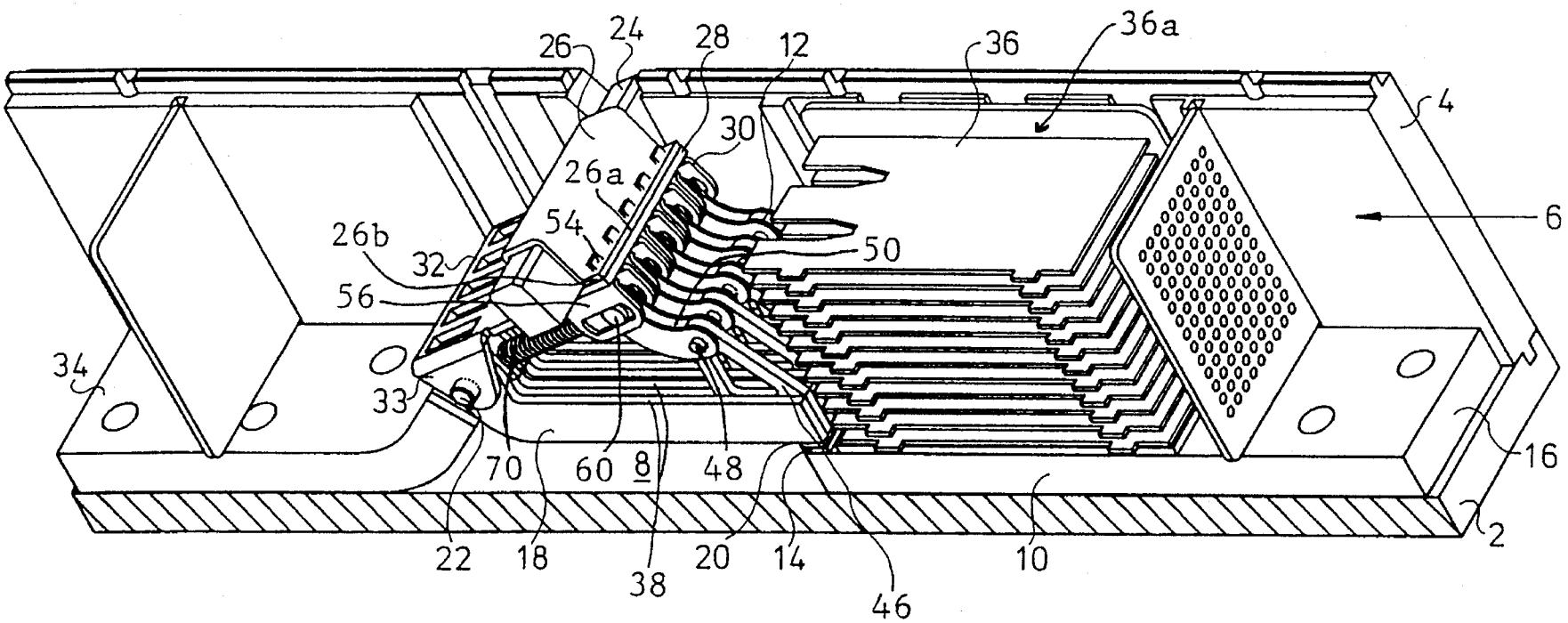
FIG. 1 shows a view in perspective of a single pole section of a multi-pole circuit breaker with a contact system according to the invention.

As shown in FIG. 1, a circuit breaker can generally include a molded housing 2. The housing 2 can preferably be separated into several pole chambers 6 by separating walls 4. Only one pole chamber 6 is shown here for purposes of simplicity, and FIG. 1 shows an outermost pole chamber 6. In the pole chamber 6, a contact system 8 can preferably be arranged, which contact system 8 can generally include a stationary contact 10 and a moveable contact 12. The stationary contact 10 can preferably support, on one end, a stationary contact piece 14, and can preferably extend outwardly at the other end into a first phase connector 16. The moveable contact 12 can preferably contain several contact fingers 18, each contact finger 18 having a moveable contact piece 20. In accordance with one embodiment, the moveable contact 12 can preferably have five contact fingers 18, however, other configurations would be within the scope of the present invention.

The contact fingers 18 of the moveable contact 12 can preferably be individually mounted on a common swivel pin 22, and can be connected to a transverse selector shaft 24, the selector shaft 24 preferably having an essentially rectangular cross-section. The connection of the moveable contact 12 to the selector shaft 24 can preferably be accomplished by means of a retaining clip 26, which clip 26 can preferably enclose the selector shaft 24 on three sides. A retaining plate 28 can preferably be attached to the retaining clip 26, the retaining plate 28 preferably being disposed on the fourth side of the selector shaft 24, that is, the side not included among the aforementioned three sides.

On the one hand, links 30 can preferably be attached on the retaining plate 28 with which links 30 the contact fingers 18 can preferably be in active contact. On the other hand, the retaining plate 28 can preferably lead or extend into an essentially U-shaped spring clip 32, which spring clip 32 can preferably be mounted by means of outer arms 33 onto the swivel pin 22, and which spring clip 32 preferably produces a pressure which is necessary, or at least adequate, for the direct electrical connection between the contact fingers 18 and a second outward leading phase connector 34. In accordance with one embodiment of the present invention, the spring clip 32 can preferably "squeeze" or clamp the contact fingers 18 against the leading phase connector 34.

The selector shaft 24 can preferably be connected in essentially the same way to the moveable contacts of the remaining poles, and, the selector shaft 24 can be connected, preferably in the region of the central pole chamber, in a manner not shown, but which is well known, to a breaker mechanism, also not shown, having an energy store, in order to connect or disconnect the stationary contact piece 14 with the moveable contact pieces 20 by manual or remote operation in essentially every pole chamber 6. Opening of all the pairs of contact pieces 14, 20 can preferably be effected by means of the breaker mechanism at appropriate pre-determined excess currents preferably by means of thermal and magnetic or electronic tripping mechanisms, with a greater or lesser delay. The pairs of contact pieces 14, 20 of the contact system 8 can preferably extend into an arcing chamber 36*a* with an arc splitter packet 36.

In other words, and in accordance with one embodiment of the present invention, the selector shaft 24 can preferably extend across the contact fingers 18 of each pole chamber 6 (only one of which is shown in FIG. 1 for purposes of simplicity), and, in the vicinity of the central pole chamber 6, the selector shaft 24 can preferably be appropriately connected to a breaker mechanism, which breaker mechanism can preferably be configured for connecting or disconnecting the contact pieces 14, 20 to or from one another, respectively, preferably in every pole chamber 6. Simultaneous opening of all the pairs of contact pieces 14, 20 can preferably be effected, by means of the selector shaft 24, and at appropriate pre-determined excess currents, by means of thermal, magnetic, or electronic tripping mechanisms.

Figure 2:
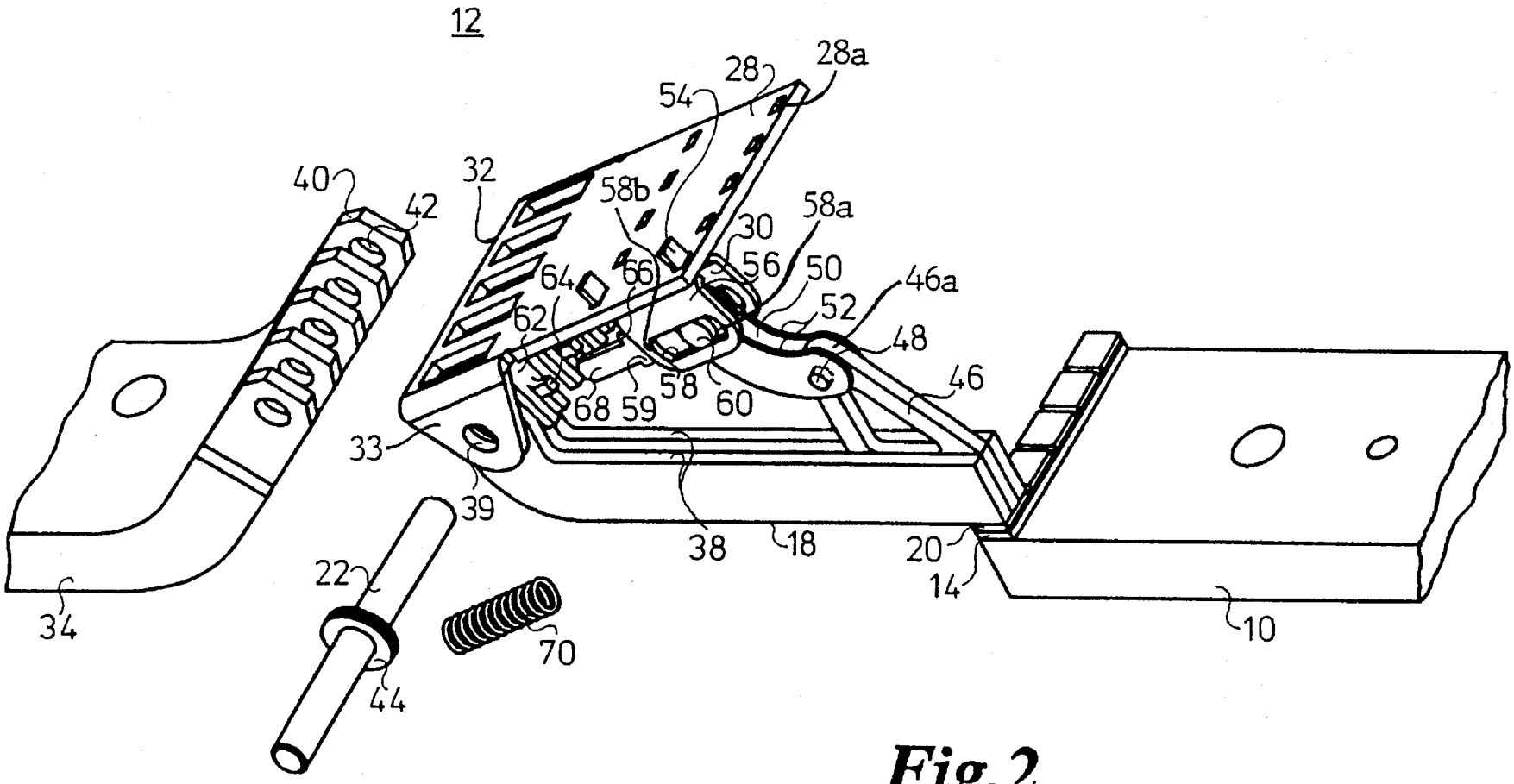
FIG. 2 shows an enlarged detail of FIG. 1 shown in a perspective and partially exploded view.

The construction of the moveable contact 12 is shown in more detail in FIG. 2. For purposes of simplicity, only one of the five contact fingers 18 is shown, the moveable contact piece 20 of which is preferably in contact with one of the stationary contact pieces 14 of the stationary contact 10. The contact fingers 18 can each preferably be composed of two essentially parallel contact strips 38, which contact strips 38 can preferably be disposed at a distance from one another. The contact strips 38 can each preferably be provided at one end with a bearing bore 39, and at the other end can preferably be connected to one another by means of the moveable contact piece 20.

On the end of the second phase connector 34, tabs 40 can be configured to correspond to the number of contact fingers 18, each of the tabs 40 preferably having a tab bore 42. The contact fingers 18 can preferably grip around the end of the tabs 40 by means of their separated contact strips 38, and can be mounted by means of the swivel pin 22 inserted through the bearing bores 39 and the tab bores 42. In order to increase the pressure of contact between the tabs 40 and the contact fingers 18, on the one hand, the pairs of contact strips 38 can preferably be mechanically pre-tensioned towards the inside, and, on the other hand, the contact fingers 18 can be subject to lateral opposing pressure from the disc springs 44 mounted on the swivel pin 22.

The swivel pin side end of the contact strips 38 with the bearing bores 39 can preferably be angled away from the moveable contact piece 20 which can preferably result generally in an L-shape. Thus, when the contact finger 18 is pivoted, a radial component of movement, in relation to the tangential plane of the stationary contact piece 14, can preferably be effected in the geometrical sense, which movement can assist in the self-cleaning of the contact pieces 14, 20.

In other words, and in accordance with one embodiment of the present invention, when the contact finger 18 is pivoted, a radial component of movement, in relation to the tangential plane of the stationary contact piece 14, can preferably be effected in the geometrical sense, which movement can preferably assist in the self-separation of the contact pieces 14, 20.

On the ends of the contact fingers 18 which have the contact piece 20, the contact fingers 18 can also generally be configured in an L-shape. The contact strips 38 can preferably form the long arm and a short, essentially triangular arm 46 can project outwardly, away from the moveable contact piece 20. The triangular arm 46 can preferably be disposed between the contact strips 38. In accordance with one embodiment of the present invention, the arm 46 can preferably be clamped between the contact strips 38. On an end 46*a* (see FIG. 2) of the arm 46 which preferably tapers to a point, one end of a rod or arm 50 can preferably be joined by means of a pin 48. The rod 50 can preferably be composed of two essentially parallel lugs or arms 52 disposed at a distance from one another, between which lugs 52 the short arm 46 can preferably be mounted. The U-shaped link or link bracket 30 for each contact finger 18 can preferably be retained by means of a central arm 54 on the retaining plate 28. Further, and in accordance with one embodiment of the present invention, the retaining plate 28 can preferably have slots 28*a* (see FIG. 2) for receiving the arms 54 of the link brackets 30. Further, retaining clip 26 can also preferably have slots 26*a* disposed on flanges 26*b* (see FIG. 1) of retaining clip 26 for receiving the arms 54.

The rod or arm 50 with its lugs or arms 52 can, in accordance with one embodiment of the present invention, have a generally curved or arc-like shape.

The link 30 can preferably be provided with outer arms 56, the outer arms 56 each preferably having an elongate link opening 58. The longitudinal axis of the opening 58 is preferably radial with respect to the swivel pin 22. Into this link opening 58 a link slider 59 can be guided, the link slider 59 having a rod axle 60 preferably attached thereto, wherein a pushing movement, preferably of a compression spring 70, can be bilaterally limited by bow-shaped ends 58*a* and 58*b* (see FIG. 2) of the link opening 58. The other end of the rod 50 opposite pin 48 can preferably be appropriately joined or fastened to the rod axle 60. The direction of the straight line of the spring force acting upon the rod axle 60, which line is essentially parallel to the longitudinal axis of the link opening 58, can preferably be at an obtuse angle (alpha) (see FIG. 3) with respect to the line of connection of the joining points of the rod 50, the joining points of the rod 50 being the pin 48 and the rod axle 60. The angle (alpha) can preferably be open to or towards the contact finger 18. The angle (alpha) can preferably be defined between lines B and C as shown in FIG. 3.

A supporting plate 62 and thereafter a first pin 64 can preferably face the contact finger 18, and can be configured by stamping out from the retaining plate 28. In other words, and in accordance with one embodiment of the present invention, pin 64 and plate 62 can preferably be formed from or on retaining plate 28. Alternatively, pin 64 and plate 62 could conceivably be separate pieces from plate 28 and could then be appropriately fastened to the plate 28. The first pin 64 preferably points radially away from the swivel pin 22. On the side opposite rod axle 60, the link slider 59 can preferably narrow and can have, at an intermediate point or area, supporting shoulders 66, and can then preferably extend into a second pin 68, which second pin 68 preferably points or extends radially towards the swivel pin 22. The contact force spring 70 can preferably be supported between the supporting plate 62 and the supporting shoulder 66, which contact force spring 70 can be configured as a helical compression spring. The contact force spring 70 can preferably be laterally retained by the pins 64, 68. Further, in accordance with one embodiment of the present invention, spring 70 can be installed onto pins 64 and 68 with a prestress, such that spring 70 will preferably exert forces in the directions indicated by double arrow A (see FIG. 3).

Figure 3:
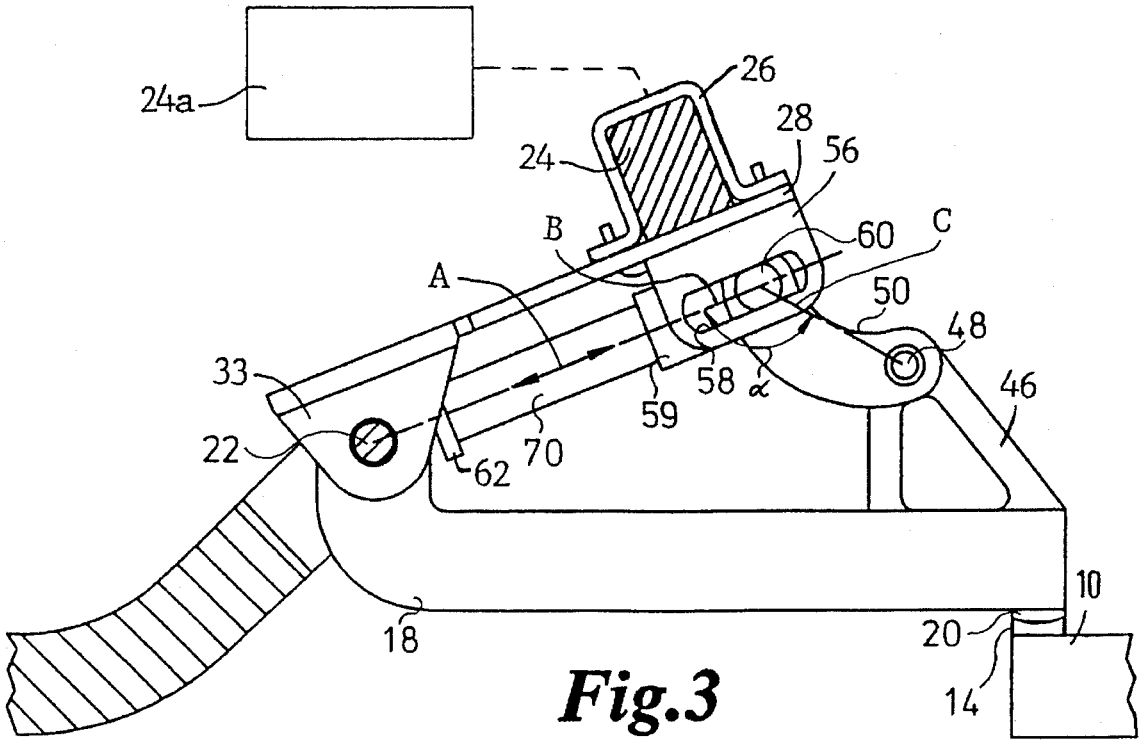
FIG. 3 shows an enlarged outline diagram of FIG. 1 with a view from the side of an internal contact finger in the "ON" state of the circuit breaker.

FIGS. 3 to 7 show the method of operation of the contact system 8, wherein the contact force spring 70 is shown schematically only, along with its force components. As stated above, in accordance with one embodiment of the present invention, the force components of spring 70 can be considered to be represented by the arrow A (see FIG. 3) FIG. 3 shows one of the contact fingers 18 in the "ON" state of the contact system 8. That is, FIG. 3 shows one of the contact fingers 18 with contact piece 20 in contact with contact piece 14, i.e. a "closed" position. Acted upon by the contact force spring 70, the link slider 59 can preferably be forced to move in the framework of the link opening 58, radially away from the swivel pin 22. As such, a component of force tangentially oriented with respect to the swivel pin 22 is exerted, preferably by means of the rod 50 on the contact finger 18, which force can produce the necessary pressure for maintaining contact between the pair of contact pieces 14, 20.

In accordance with one embodiment of the present invention, the angle (alpha) can preferably have a value of about 130° preferably when the contact finger 18 is in the "closed" position as shown in FIG. 3, and when there is essentially no wear of the contact pieces 14, 20. Of course, angle (alpha) is not to be taken as limited to this value and, thus, variations may be possible in accordance with the present invention.

Figure 4:
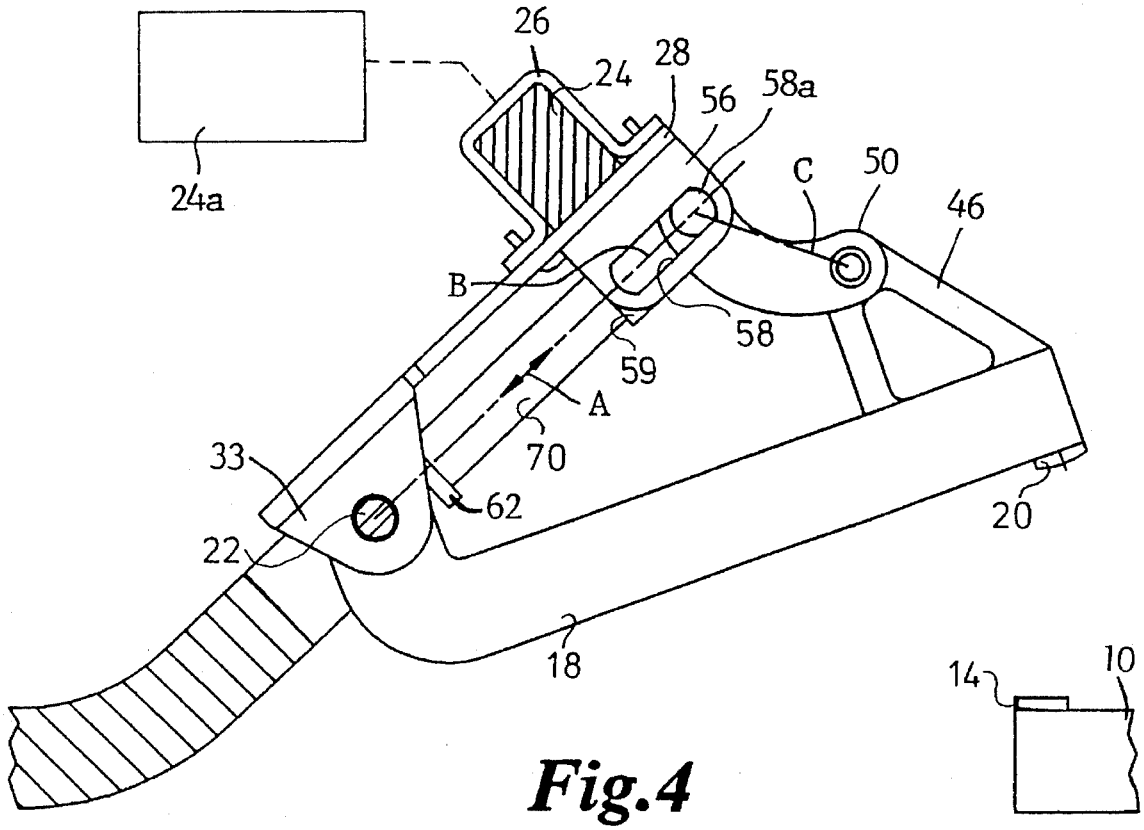
FIG. 4 shows an enlarged outline diagram of FIG. 1, however in the "OFF" state of the circuit breaker.

As shown in FIG. 4, during switching off or tripping of the moveable contacts 12 of all of the poles 6, and thus all of the contact fingers 18, the contact fingers 18 can preferably be pivoted about the swivel pin 22 preferably by means of a pivoting movement of the selector shaft 24, whereby the pairs of contact pieces 14, 20 can preferably be separated from one another. As a result of the lack of opposing pressure of contact preferably between contact pieces 14, 20, the link slider 59 is preferably pushed as far as the outer end side limit 58*a* (see FIG. 4) of the link opening 58.

In accordance with one embodiment of the present invention, once the contact fingers 18 have been tripped as described above, the contact fingers 18, with their contact piece 20, can preferably be moved back into contact with contact piece 14, when appropriate, by means of a closing mechanism 24*a*, as shown in FIGS. 3–7. The closing mechanism 24*a* can preferably be operatively connected to the selector shaft 24, or alternatively, could be operatively connected to the contact fingers 18 themselves.

Figure 5:
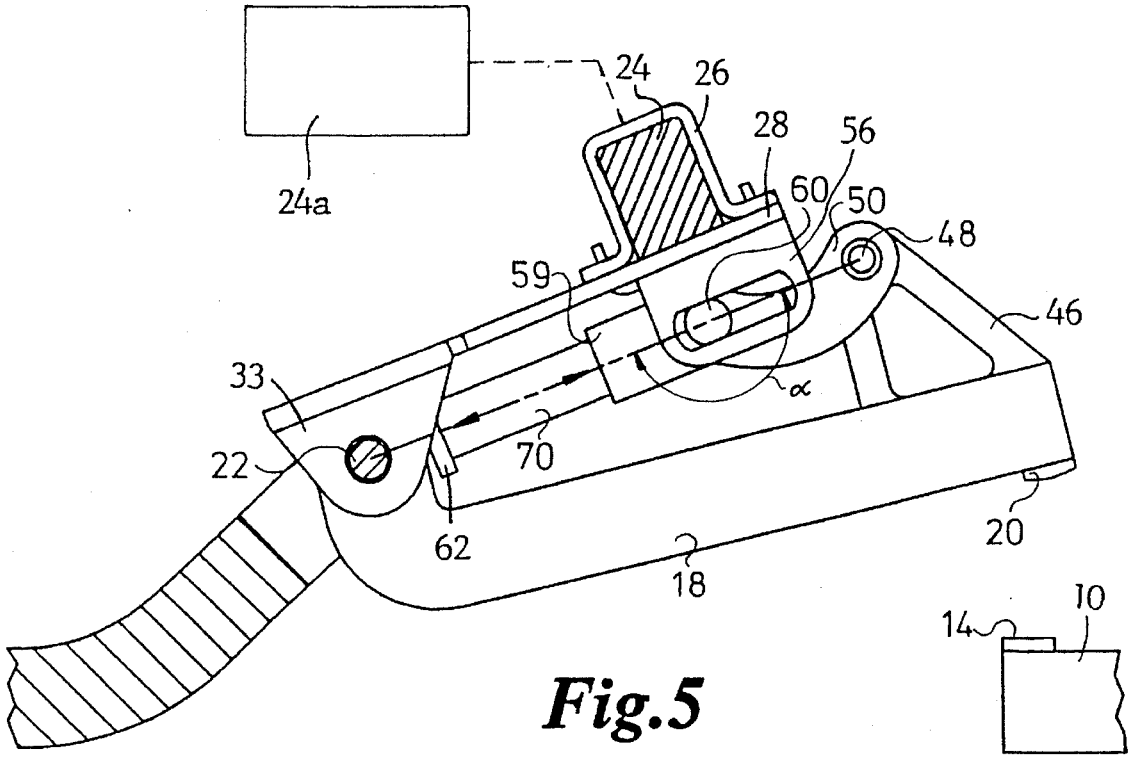
FIG. 5 shows an enlarged outline diagram of FIG. 1, during the electrodynamic opening of the contact finger.

When in the closed position of the pairs of contact pieces 14, 20 according to FIG. 3, a short circuit current can preferably flow over the contact fingers 18, the electrodynamic high density current of which short circuit current is higher in the proximity of the pairs of contact pieces 14, 20 than the contact pressure force exerted by the contact force spring 70. At this point, the contact fingers 18 can preferably be "spun" away from the stationary contact 14. In other words, the high density current of the short circuit current can "overpower" the force of spring 70, and thus cause contact fingers 18 to move away from contact piece 14. The electrodynamic force can preferably effect a component of force radially with respect to the swivel pin 22 preferably by means of the rod 50, which rod 50 preferably displaces the link slider 59 in opposition to the effect of the force of the contact force spring 70. Preferably as a result of the obtuseness of the angle (alpha), the amount of this electrodynamic component of force increases, preferably until the tilted position shown in FIG. 5 is reached. This tilted position is characterized in that the swivel pin 22, the contact force spring 70, the link slider 59 and the rod axle 60, as well as the pin 48 of the rod 50, are preferably in an essentially straight line, that is, the angle (alpha) is preferably extended. In accordance with one embodiment of the present invention, angle (alpha) can preferably be extended to an angle of about 180° as shown in FIG. 5.

Figure 6:
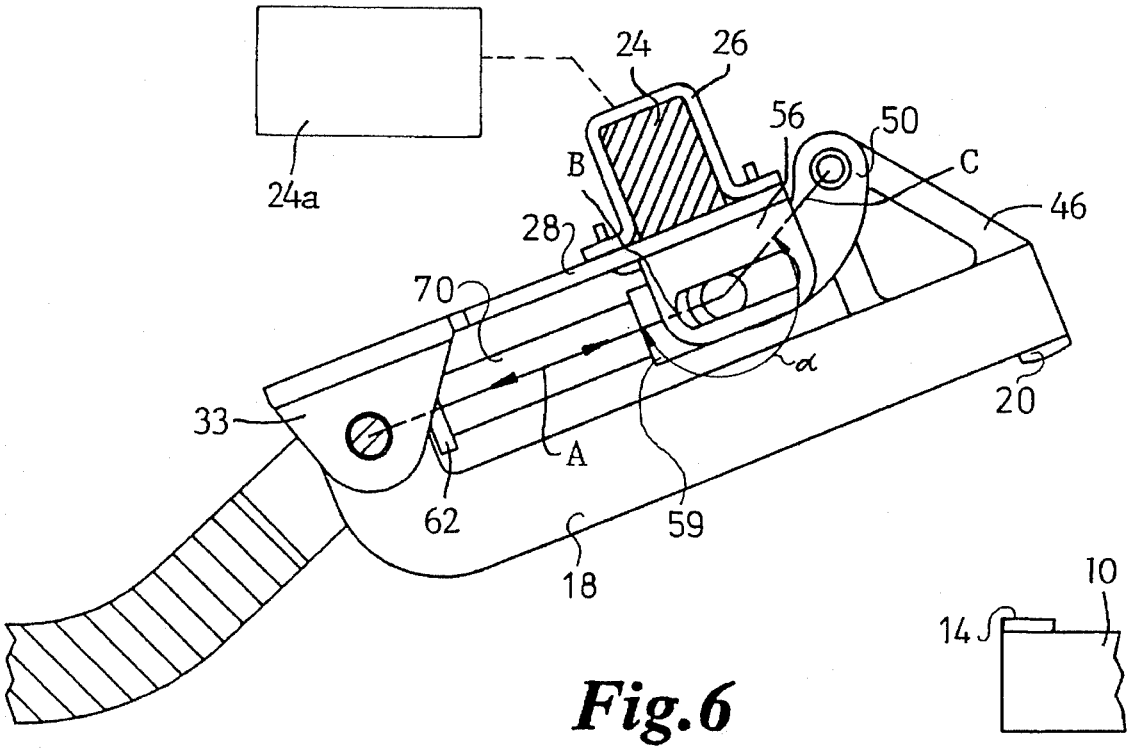
FIG. 6 shows an enlarged outline diagram of FIG. 1, after electrodynamic opening of the contact finger.

With further opening of the pairs of contact pieces 14, 20, that is to say over-extension of the angle (alpha), the direction of effect of the components of force exerted upon the contact finger 18 by the contact force spring 70 via the link slider 59 and the rod 50 preferably reverses. Essentially from this point on, the contact finger 18 preferably tilts into the stable position shown in FIG. 6, essentially solely under the effect of the contact force spring 70. In accordance with one embodiment of the present invention, angle (alpha) can preferably have a value of about 210° as shown in FIG. 6. By means of this advantageous toggle mechanism connected to the contact finger 18, the risk of the "pumping" of the contact finger 18 occurring as a result of the limiting of the current taking place, and thus of potential damaging welding or possibly burning of the pair of contact pieces 14, 20 can be significantly reduced. In other words, the contact finger 18 can be held in an essentially stable position with respect to contact piece 14, which stable position can reduce the possibility of an up and down movement of the contact finger 18 which movement could cause repeated and potentially damaging contact of the contact pieces 14, 20. By means of the subsequently tripped breaker mechanism, the contact finger 18 can preferably be tilted back into a position analogous to FIG. 4 preferably by means of a return stop, which is not shown here but which return stop is well known and can be essentially stationary with respect to the molded housing. For example, such a return stop could conceivably be embodied by an essentially stationary component (with respect to the housing 2), whether an extension or protrusion from the housing 2 or an integral portion of the housing 2 itself, which comprises a surface or portion that can preferably serve to limit movement of the contact fingers 18 in a direction away from the contact piece 14.

FIG. 6 further shows that the rod 50 can preferably be curved away from the moveable contact piece 20, in order to obtain a large degree of opening of the electrodynamically opened pair of contact pieces 14, 20, preferably before this opening movement can be limited by the contacting of the rod 50 against the retaining plate 28.

Figure 7:
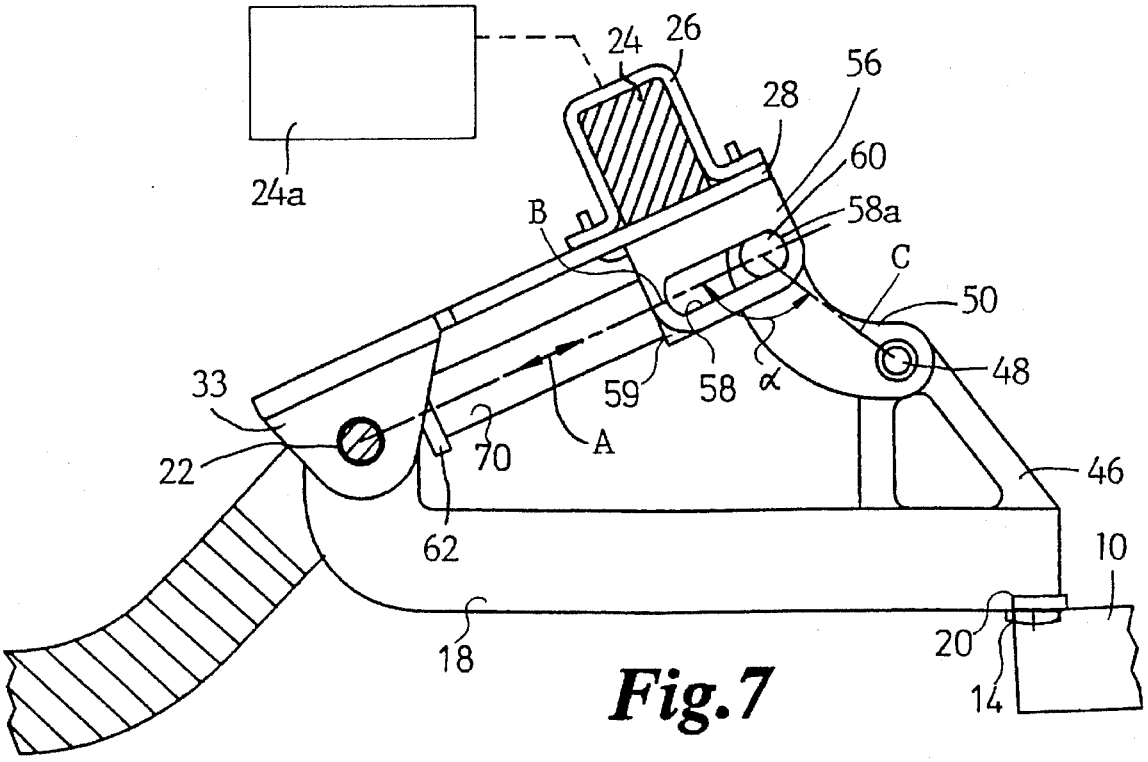
FIG. 7 shows an enlarged outline diagram of FIG. 1, showing worn contact pieces.

In FIG. 7 it is shown, in contrast to FIG. 3, how a reliable contact can be obtained as the contact pieces 14, 20 wear out typically as a result of burning, until the maximum travel is reached. Preferably as a result of the obtuseness of the angle (alpha), the component of force exerted by the contact force spring 70 on the contact finger 18 and directed towards the stationary contact piece 14, that is, the contact compression force, preferably increases with increasing travel, that is, with increasing wear of the contact pieces 14, 20. As such, the degradation of the contact properties as a result of burning can preferably be counteracted in a manner which can be considered to be over-compensatory. This increase in contact compression force can preferably take place until the travel of contact finger 18 is limited to its maximum value by the limiting of the pushing movement of the link slider 59 by the outer end side limitation 58*a* (see FIG. 7) of the link opening 58. In other words, the wear of contact pieces 14, 20 can be compensated for because the rod 50 and rod axle 60 will preferably move towards end 58*a* of opening 58 until axle 60 contacts end 58*a*, thereby permitting contact finger 18 to travel farther in order to make contact with contact piece 20.

Figure 8:
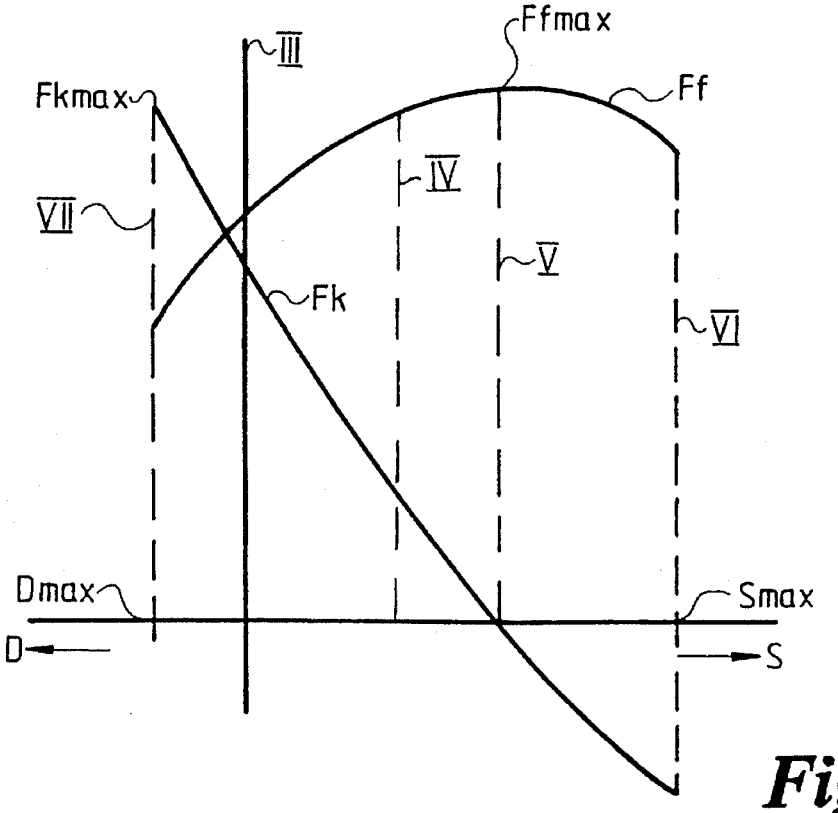
FIG. 8 shows qualitative diagrams of forces in the contact system according to the preceding figures.

In FIG. 8 advantageous effects of the contact system 8 according to the present invention are shown with reference to the essential forces which preferably occur in the toggle mechanism preferably connected to the contact fingers 18. On the one hand, the effects of the contact system 8 are shown as being dependent upon the degree of opening S of the pair of contact pieces 14, 20, and, on the other hand dependent upon the travel D when the contact pieces 14, 20 are worn. The qualitative behavior of spring force Ff developed by the contact force spring 70 and the components of force Fk effected and thereby directed towards the stationary contact piece 14 is shown. The line III can preferably correspond to the "ON" state with unworn contact pieces 14, 20 according to FIG. 3. The component of force Fk preferably corresponds in this state to the contact compression force. In the region between the line III and the line IV, an electrodynamic opening force caused by a short circuit preferably acts upon the contact finger 18 against the component of force Fk. Although with an increasing degree of opening S, the spring force Ff is preferably greater, the component of force Fk is advantageously smaller. The line V corresponds to the tilted position of the toggle mechanism shown in FIG. 5. As such, the maximum spring force Ffmax occurs, and the amount of the component of force Fk is preferably nil or zero. In the direction of line VI the conditions have altered substantially. The spring force Ff is decreasing and the direction of the component of force Fk reverses. On the line VI the electrodynamically effected stable opening position is preferably reached, with the maximum degree of opening Smax, as shown in FIG. 6. In the region of the line III to the line VII the relationships are shown when there is increasing travel of the contact finger 18 as a result of increasing wear of the contact pieces 14, 20. Although with increasing travel D, the spring force Ff decreases, the component of force Fk acting as contact compression force increases in an advantageous manner. This increase preferably takes place until the maximum component of force Fkmax (maximum contact compression force) is obtained on the line VII, where the maximum travel Dmax according to FIG. 7 is preferably reached.

An additional embodiment of the present invention not shown here features a toggle system which preferably has two toggles, which are preferably joined with their free ends between the selector shaft 24 and the contact finger 18, and on or with the inner articulated connection of which the contact force spring 70 can preferably be gripped.

Figure 9:
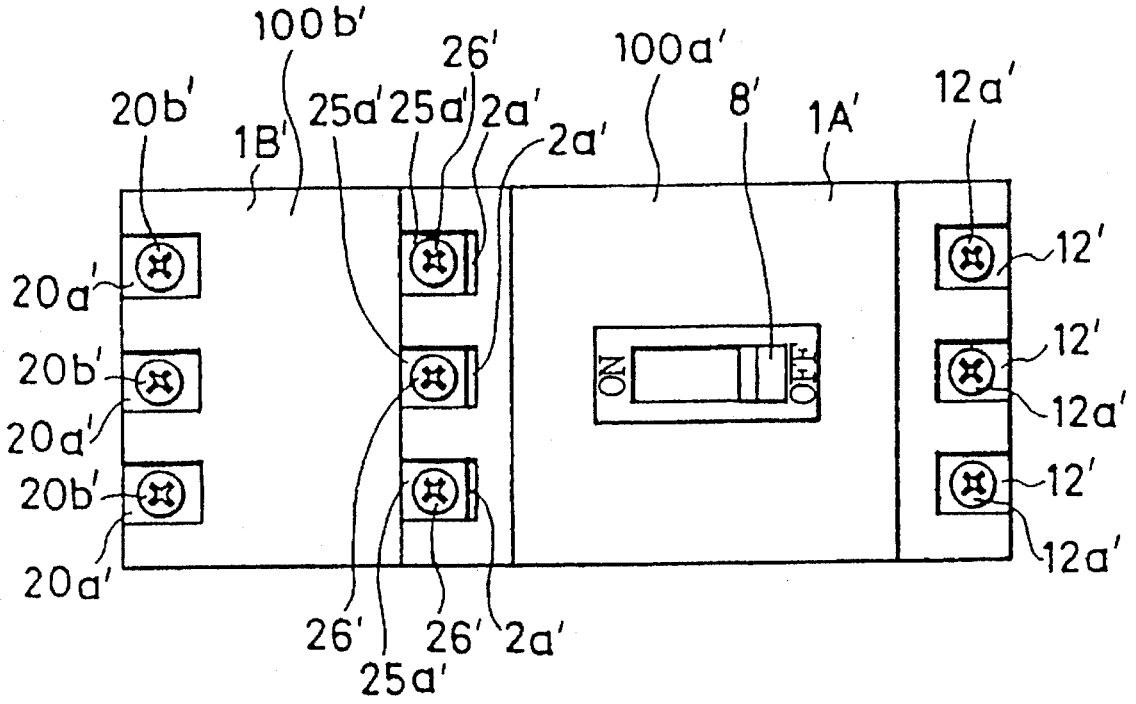
FIG. 9 is a plan view showing a current limiting circuit breaker in which the present invention may be employed.

As shown in FIG. 9, a current limiting circuit breaker, in which the present invention may be employed, may preferably comprise a circuit breaker unit 1A' and a current limiting unit 1B', which current limiting unit 1B' can preferably be attached to the side face of the circuit breaker unit 1A'. Three load side terminals 12' may be provided on the right side end of the circuit breaker unit 1A' shown in FIG. 9, and three power source side terminals 20*a*' may be provided on the left side end of the current limiting unit 1B' shown in FIG. 9. The circuit breaker unit 1A' and the current limiting unit 1B' can be formed integrally by connecting a conductor 2' of the circuit breaker unit 1A' and a connection conductor 25' of the current limiting unit 1B' (see FIG. 10).

Figure 10:
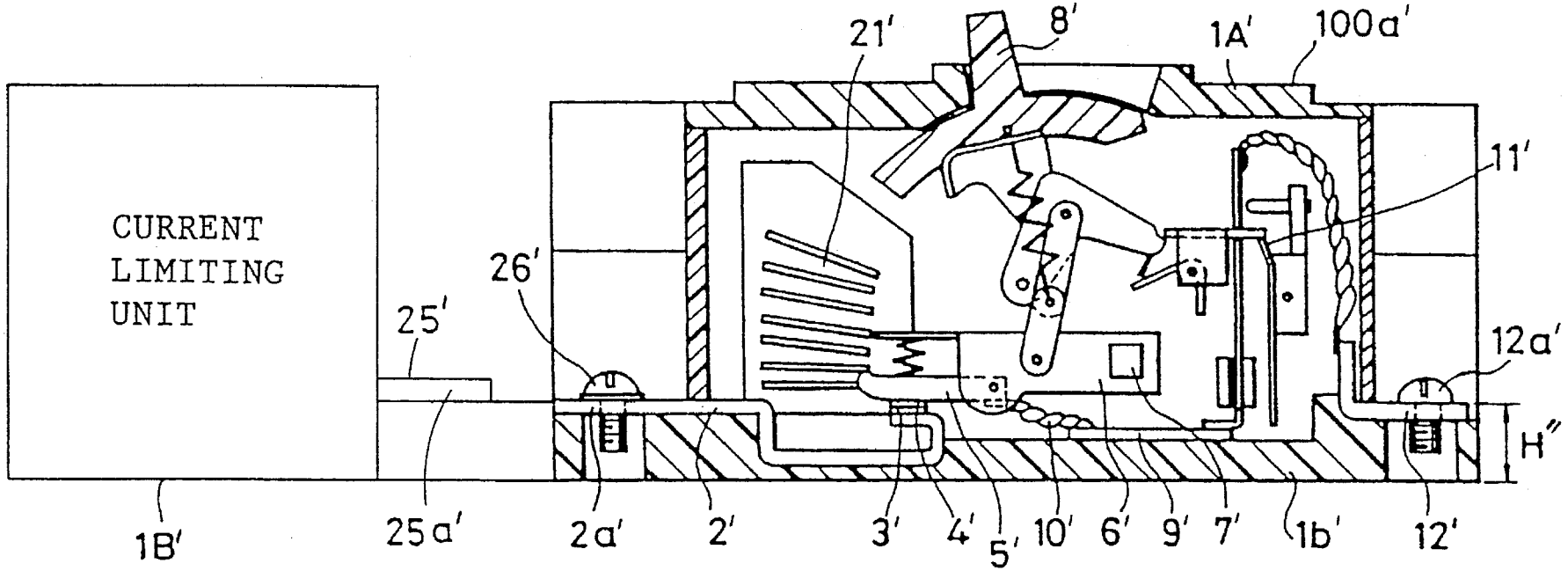
FIG. 10 is a longitudinal sectional side exploded view showing the current limiting circuit breaker of FIG. 9, with a current limiting unit removed therefrom.

In the circuit breaker unit 1A' shown in FIG. 10, for instance, three stationary conductors 2' may be fixed to a bottom 1*b*' of the circuit breaker casing 100*a*', and at the inner end of each of the stationary conductors 2', there can be corresponding stationary contacts 3'. Movable contacts 4', facing towards the stationary contacts 3', can be provided on movable members 5' which are movably held by contact arms 6', respectively. Each contact arm 6' can be rotatably supported by a cross bar 7'. An operation handle 8' can be provided projecting upward from the substantial center of the front face (upper face in FIG. 10) of the circuit breaker casing 100*a*'. The contact arms 6' can be turned about the cross bar 7' by turning the operation handle 8'. Conductors 9', which can be fixed to the bottom 1*b*' of the circuit breaker casing 100*a*', can connect one end of the flexible connection members 10', and the other ends of the flexible connection members 10' can be connected to the movable members 5'.

The fixed conductors 9' can be electrically connected to the load side terminals 12' through overcurrent trip units 11', respectively.

As shown in FIG. 10, the connection terminal 2a' having terminal screw bolts 26' and the load side terminal 12' having terminal screw bolts 12a' can be provided on both sides of the circuit breaker unit 1A'. A height (H') of the connection terminal 2a' and a height (H") of the load side terminal 12' can be provided at the same height measured between each upper face of them and the lower face of the circuit breaker casing 100a. A connection terminal 25a' of the connection conductor 25' can be projected from the side face of the current limiting unit 1B', and can be provided to ride on the connection terminal 2a' of the circuit breaker unit 1A'. The power source side terminal 20a' of the current limiting unit 1B' can be provided to have height H' from the rear face of the current limiting casing 100b' as shown in FIG. 9, and a terminal screw bolt 20b' can be attached thereto.

As shown by the perspective view of FIG. 11, by assembling into a unit of the current limiting unit 1B' previously, the current limiting unit 1B' can be connected with the circuit breaker unit 1A', when the current limiting unit 1B' is juxtaposed with the circuit breaker unit 1A' as shown in FIGS. 9 and 10. Because the connection terminal 25a' of the current limiting unit 1B' is disposed on the connection terminal 2a' of the circuit breaker unit 1A', the current limiting unit 1B' can laterally be connected integrally with the circuit breaker unit 1A' by using the terminal screw bolt 26' as shown in FIG. 9.

In FIG. 10, arc extinguishing chambers, disposed within housing 100a', are indicated at 21'.

Apart from the layout described hereinabove wherein one current limiting unit 1B' is connected with the circuit breaker unit 1A', a modification may be made such that essentially any number of current limiting units 1B' may be connected as needed. For example, three current limiting units 1B' may be connected in series as shown in FIGS. 12 and 13, thereby increasing current limiting ability.

The appended drawings in their entirety, including dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A current limiting unit for a circuit breaker, said unit comprising:

housing means;

at least one contact system disposed at least partly within said housing means;

said contact system for being operatively associated with a circuit breaker;

said contact system comprising:

first means for conveying electrical current;

second means for conveying electrical current;

means for providing electrical communication between said first means for conveying current and said second means for conveying current;

said means for providing electrical communication comprising:

toggle means, said toggle means having means for conveying electrical current;

first connecting means for electrically connecting said toggle means with said first means for conveying current;

second connecting means for electrically connecting said toggle means with said second means for conveying current;

said first connecting means comprising:

a first contact portion operatively connected to said toggle means;

a second contact portion disposed on said first means for conveying current;

said first contact portion and said second contact portion being disposed to be engageable with one another to electrically connect said toggle means with said first means for conveying current;

means for displaceably mounting said toggle means to permit displacement of said toggle means into at least a first position, wherein said first contact portion and said second contact portion are engaged with one another, and a second position, wherein said first contact portion and said second contact portion are disengaged from one another to disrupt the electrical connection between said toggle means and said first means for conveying current;

means for biasing said toggle means such that said toggle means will remain in said second position upon disruption of the electrical connection between said toggle means and said first means for conveying current;

said toggle means comprising:

contact arm means, said first contact portion being disposed on said contact arm means;

toggle arm means having a first end portion and a second end portion and an axis defined between said first end portion and said second end portion;

said first end portion of said toggle arm means being operatively connected to said contact arm means;

said second end portion of said toggle arm means being disposed adjacent said biasing means;

said biasing means having a longitudinal axis and being disposed to provide a biasing force along the longitudinal axis of said biasing means, the biasing force acting on said second end portion of said toggle arm means, said toggle arm means for transferring the biasing force of said biasing means so as to bias said contact arm means such that said toggle means will remain in said second position; and said axis of said toggle arm means forming an angle of greater than about 90° with respect to the longitudinal axis of said biasing means, with said toggle means being in said second position and with the electrical connection between said toggle means and said first means for conveying current having been disrupted, said toggle arm means assuming a rest position with said toggle means being in said second position.

2. The current limiting unit according to claim 1 wherein said biasing means is disposed to additionally bias said toggle means so as to maintain said first contact portion and said second contact portion in engagement with one another in said first position of said toggle means, to maintain the electrical connection between said toggle means and said first means for conveying current.

3. The current limiting unit according to claim 2 wherein:

said toggle arm means comprises a curved portion disposed between said first end portion and said second end portion, said curved portion having a first side portion and a second side portion;

said first side portion being generally convex and facing said contact arm means; and said second side portion being generally concave and facing away from said contact arm means.

4. The current limiting unit according to claim 3 wherein:

said angle is a first angle;

said biasing means provides a biasing force along the longitudinal axis of said biasing means, the biasing force acting on said second end portion of said toggle arm means, said toggle arm means for transferring this biasing force so as to bias said contact arm means such that said toggle means remains in said first position; and said axis of said toggle arm means forms a second angle of greater than about 90° with respect to the longitudinal axis of said biasing means in said first position of said toggle means, said first angle and said second angles being obtuse angles.

5. The current limiting unit according to claim 4 wherein said biasing force transferred to said contact arm means by said toggle arm means in said first position of said toggle means increases as a function of wear of at least one of said first contact portion and said second contact portion.

6. The current limiting unit according to claim 5 wherein:

said biasing means comprises at least one spring;

said toggle means further comprises a retaining plate, said retaining plate having means for operatively attaching said second end portion of said toggle arm means to said retaining plate; and said means for operatively attaching has means for permitting displacement of said second end portion of said toggle arm means with respect to said retaining plate, said at least one spring being configured to displace said second end portion with respect to said retaining plate.

7. The current limiting unit according to claim 6 wherein:

said contact arm means has a first end and a second end disposed at a substantial distance from one another, said first contact portion being disposed on said first end of said contact arm means;

said second end of said contact arm means has means for permitting pivoting movement of said contact arm means with respect to said retaining plate, said at least one spring being disposed between said contact arm means and said retaining plate;

said contact arm means comprises a first portion and a second portion, each of said first and second portions of said contact arm means having a length, said first end of said contact arm means being disposed at said first portion of said contact arm means and said second end of said contact arm means being disposed at said second portion of said contact arm means; and said first portion of said contact arm means and said second portion of said contact arm means are disposed, with respect to one another, to form a substantially L-shape, the length of said first portion of said contact arm means being substantially greater than the length of said second portion of said contact arm means.

8. The current limiting unit according to claim 7 wherein:

said second connecting means comprises:

said second end of said contact arm means; and tab means disposed on said second means for conveying current, said tab means being in contact with said second end of said contact arm means to provide electrical communication between said contact arm means and said second means for conveying current.

9. The current limiting unit according to claim 8 wherein:

said first contact portion comprises a plurality of contact pieces;

said second contact portion comprises a plurality of contact pieces disposed on said first means for conveying current;

said tab means comprises a plurality of tabs disposed on said second means for conveying current;

said contact arm means comprises a plurality of contact arm arrangements disposed substantially parallel to one another;

said toggle means comprises a plurality of toggle arm arrangements, each one of said plurality of toggle arm arrangements being associated with a corresponding one of said plurality of said contact arm arrangements;

each one of said plurality of contact arm arrangements comprise two contact fingers substantially identical to one another and disposed in a spaced-apart, substantially parallel, relationship with respect to one another, each of said plurality of tabs being disposed between said two contact fingers of corresponding ones of said plurality of contact arm arrangements;

each one of said plurality of toggle arm arrangements comprises two lugs substantially identical to one another and disposed in a spaced-apart, substantially parallel, relationship with respect to one another;

said toggle means further comprises a plurality of arms disposed to connect said first end portions of said plurality of said toggle arm arrangements to corresponding ones of said plurality of contact arm arrangements: and ones of said plurality of arms being disposed between said two lugs of corresponding ones of said plurality of toggle arm arrangements and being disposed between said two contact fingers of corresponding ones of said plurality of contact arm arrangements, each of said plurality of contact pieces of said first contact portion being disposed to connect said two contact arms to one another and to clamp ones of said plurality of arms between said two contact arms.

10. The current limiting unit according to claim 9 wherein:

each of said plurality of tabs comprises a hole disposed therein;

said retaining plate has a first end portion and a second end portion disposed a substantial distance from one another, said means for operatively attaching being disposed at said first end portion;

said means for displaceably mounting comprises:

a first arm and a second arm disposed on said second end portion of said retaining plate, said first arm and said second arm each having holes disposed therein;

said first arm and said second arm are disposed substantially perpendicular to said retaining plate;

said means for permitting pivoting movement of said second end of said contact arm means, said means for permitting movement comprising holes disposed in each of said two contact arms of said plurality of said contact arm arrangements;

a pin extending through said holes of ones of said plurality of tabs, said holes of said first arm and said second arm of said retaining plate, and said holes of each of said two contact arms of said plurality of contact arm arrangements; and said first arm and said second arm and said retaining plate form a substantially U-shaped retaining clip, said U-shaped retaining clip being disposed adjacent the two outermost ones of said plurality of contact arm arrangements to substantially enclose said plurality of contact arm arrangements.

11. The current limiting unit according to claim 10 wherein:

said current limiting unit further comprises:

shaft means disposed on said upper side of said retaining plate;

means for attaching said shaft means to said retaining plate, said means for attaching said shaft means to said retaining plate comprises a substantially U-shaped retaining clip;

means for commonly attaching said retaining clip to said retaining plate and for attaching said plurality of brackets to said retaining clip;

said two contact arms of said plurality of contact arm arrangements are configured such that said two contact arms are pretensioned towards a corresponding one of said tabs disposed between said two contact arms;

said means for permitting displacement of said second end portion of said toggle arm means comprises a plurality of brackets each having a first side portion and a second side portion, said two lugs of ones of said plurality of toggle arm arrangements being disposed between said first side portions and said second side portions of corresponding ones of said plurality of brackets;

said plurality of brackets comprise a U-shape;

said first side portions and said second side portions of said plurality of brackets each have an elongated opening, said elongated openings of said first side portions and said second side portions being in substantial alignment with one another;

said elongated openings each having a first terminal portion and a second terminal portion, said first terminal portions being disposed adjacent ones of said plurality of springs and said second terminal portions being disposed a substantial distance from ones of said plurality of springs;

said toggle means further comprises:

a plurality of rods disposed substantially perpendicular to said two lugs of ones of said plurality of toggle arm arrangements, ones of said plurality of rods being fixedly attached to said second end portions of said two lugs;

ones of said plurality of rods each having end portions disposed a substantial distance from one another, said end portions of said plurality of rods being disposed in corresponding ones of said elongated openings of said first side portions and said second side portions of said plurality of brackets, to permit movement of said two lugs of ones of said plurality of toggle arm arrangements;

a plurality of slider portions fixedly attached to corresponding ones of said plurality of rods, said plurality of slider portions being radially displaceable with respect to said pin, the displacement of said plurality of slider portions being limited by the movement of said end portions of said rods within said elongated openings;

said at least one spring comprises a plurality of helical compression springs each having a first end and a second end, each of said first ends of ones of said plurality of springs being disposed about, and being supported by, at least a portion of corresponding ones of said plurality of slider portions;

said plurality of springs each being configured to bias said rods further towards said second terminal portions of said elongated openings in said first position of said toggle means upon wear of at least one of said first contact portion and said second contact portion, than in said first position of said toggle means when there is no wear of said at least one of said first contact portion and said second contact portion, to permit said plurality of contact arm arrangements to travel farther towards said first contact portion;

said retaining plate has an upper side and a lower side facing away from one another, said means for operatively attaching being disposed on said lower side;

said retaining plate comprises a plurality of supporting plates disposed substantially perpendicular to said retaining plate on said lower side of said retaining plate and at said second end portion of said retaining plate;

said plurality of supporting plates each comprising supporting pins disposed substantially parallel to said retaining plate, said second ends of said plurality of springs being disposed about, and being supported by, corresponding ones of said supporting pins;

said at least a portion of ones of said plurality of said slider portions about which said first ends of corresponding springs are disposed each comprise a pin portion, each of said pin portions having shoulders for supporting said first ends of said springs;

said toggle means being limited in its movement between said first position and said second position by the movement of said first contact portion;

said plurality of supporting plates and said plurality of said supporting pins are configured to be stamped out from said retaining plate, said plurality of supporting plates and said plurality of supporting pins being substantially integral with said retaining plate;

said toggle means being associated with at least one additional similar toggle means;

said second portion of said contact arm means is disposed at an angle with respect to said first portion of said contact arm means;

said pin comprises at least one disc spring disposed thereabout for biasing said two contact contact arms of said plurality of contact arm arrangements towards a corresponding one of said plurality of tabs; and said shaft means comprises a transverse selector shaft.

12. A current limiting unit for a circuit breaker, said unit comprising:

housing means;

at least one contact system disposed at least partly within said housing means;

said contact system for being operatively associated with a circuit breaker;

said contact system comprising:

first means for conveying electrical current;

second means for conveying electrical current;

means for providing electrical communication between said first means for conveying current and said second means for conveying current;

said means for providing electrical communication comprising:

toggle means, said toggle means having means for conveying electrical current;

first connecting means for electrically connecting said toggle means with said first means for conveying current;

second connecting means for electrically connecting said toggle means with said second means for conveying current;

said first connecting means comprising:

a first contact portion operatively connected to said toggle means;

a second contact portion disposed on said first means for conveying current;

said first contact portion and said second contact portion being disposed to be engageable with one another to electrically connect said toggle means with said first means for conveying current;

means for displaceably mounting said toggle means to permit displacement of said toggle means into at least a first position, wherein said first contact portion and said second contact portion are engaged with one another, and a second position, wherein said first contact portion and said second contact portion are disengaged from one another to disrupt the electrical connection between said toggle means and said first means for conveying current;

means for biasing said toggle means such that said toggle means will remain in said second position upon the disruption of the electrical connection between said toggle means and said first means for conveying current;

said toggle means comprising:

contact arm means, said first contact portion being disposed on said contact arm means;

toggle arm means having a first end portion and a second end portion;

said first end portion of said toggle arm means being operatively connected to said contact arm means;

said second end portion of said toggle arm means being disposed adjacent said biasing means; and said biasing means being disposed to provide a biasing force on said second end portion of said toggle arm means, said toggle arm means for transferring the biasing force to said contact arm means so as to bias said contact arm means towards said first means for conveying to maintain said first contact portion and said second contact portion in engagement with one another in said first position of said toggle means, the biasing force transferred to said contact arm means in said first position of said toggle means increasing as a function of wear of at least one of said first contact portion and said second contact portion.

13. The current limiting unit according to claim 12 wherein said biasing means is disposed to additionally bias said toggle means so as to maintain said first contact portion and said second contact portion in engagement with one another in said first position of said toggle means, to maintain the electrical connection between said toggle means and said first means for conveying current.

14. The current limiting unit according to claim 13 wherein:

said toggle arm means comprises a curved portion disposed between said first end portion and said second end portion, said curved portion having a first side portion and a second side portion;

said first side portion being generally convex and facing said contact arm means; and said second side portion being generally concave and facing away from said contact arm means.

15. The current limiting unit according to claim 14 wherein:

said biasing means has a longitudinal axis and is disposed to provide a biasing force along the longitudinal axis of said biasing means, the biasing force acting on said second end portion of said said toggle arm means;

said toggle arm means has an axis defined between said first end portion and said second end portion of said toggle arm means; and said axis of said toggle arm means forms an angle of greater than about 90° with respect to the longitudinal axis of said biasing means in said second position of said toggle means, said toggle arm means assuming a rest position in said second position of said toggle means.

16. The current limiting unit according to claim 15 wherein:

said angle is a first angle;

said biasing means provides a biasing force along the longitudinal axis of said biasing means, the biasing force acting on said second end portion of said toggle arm means, said toggle arm means for transferring this biasing force so as to bias said contact arm means such that said toggle means remains in said first position; and said axis of said toggle arm means forms a second angle of greater than about 90° with respect to the longitudinal axis of said biasing means in said first position of said toggle means, said first angle and said second angles being obtuse angles.

17. The current limiting unit according to claim 16 wherein:

said biasing means comprises at least one spring;

said toggle means further comprises a retaining plate, said retaining plate having means for operatively attaching said second end portion of said toggle arm means to said retaining plate; and said means for operatively attaching has means for permitting displacement of said second end portion of said toggle arm means with respect to said retaining plate, said at least one spring being configured to displace said second end portion with respect to said retaining plate.

18. The current limiting unit according to claim 17 wherein:

said contact arm means has a first end and a second end disposed at a substantial distance from one another, said first contact portion being disposed on said first end of said contact arm means;

said second end of said contact arm means has means for permitting pivoting movement of said contact arm means with respect to said retaining plate, said at least one spring being disposed between said contact arm means and said retaining plate;

said contact arm means comprises a first portion and a second portion, each of said first and second portions of said contact arm means having a length, said first end of said contact arm means being disposed at said first portion of said contact arm means and said second end of said contact arm means being disposed at said second portion of said contact arm means; and said first portion of said contact arm means and said second portion of said contact arm means are disposed, with respect to one another, to form a substantially L-shape, the length of said first portion of said contact arm means being substantially greater than the length of said second portion of said contact arm means.

19. The current limiting unit according to claim 18 wherein:

said second connecting means comprises:

said second end of said contact arm means; and tab means disposed on said second means for conveying current, said tab means being in contact with said second end of said contact arm means to provide electrical communication between said contact arm means and said second means for conveying current.

20. The current limiting unit according to claim 19 wherein:

said first contact portion comprises a plurality of contact pieces;

said second contact portion comprises a plurality of contact pieces disposed on said first means for conveying current;

said tab means comprises a plurality of tabs disposed on said second means for conveying current;

said contact arm means comprises a plurality of contact arm arrangements disposed substantially parallel to one another;

said toggle means comprises a plurality of toggle arm arrangements, each one of said plurality of toggle arm arrangements being associated with a corresponding one of said plurality of said contact arm arrangements;

each one of said plurality of contact arm arrangements comprise two contact fingers substantially identical to one another and disposed in a spaced-apart, substantially parallel, relationship with respect to one another, each of said plurality of tabs being disposed between said two contact fingers of corresponding ones of said plurality of contact arm arrangements;

each one of said plurality of toggle arm arrangements comprises two lugs substantially identical to one another and disposed in a spaced-apart, substantially parallel, relationship with respect to one another;

said toggle means further comprises a plurality of arms disposed to connect said first end portions of said plurality of said toggle arm arrangements to corresponding ones of said plurality of contact arm arrangements; and ones of said plurality of arms being disposed between said two lugs of corresponding ones of said plurality of toggle arm arrangements and being disposed between said two contact fingers of corresponding ones of said plurality of contact arm arrangements, each of said plurality of contact pieces of said first contact portion being disposed to connect said two contact arms to one another and to clamp ones of said plurality of arms between said two contact arms;

each of said plurality of tabs comprises a hole disposed therein;

said retaining plate has a first end portion and a second end portion disposed a substantial distance from one another, said means for operatively attaching being disposed at said first end portion;

said means for displaceably mounting comprises:

a first arm and a second arm disposed on said second end portion of said retaining plate, said first arm and said second arm each having holes disposed therein;

said first arm and said second arm are disposed substantially perpendicular to said retaining plate;

said means for permitting pivoting movement of said second end of said contact arm means, said means for permitting movement comprising holes disposed in each of said two contact arms of said plurality of said contact arm arrangements;

a pin extending through said holes of ones of said plurality of tabs, said holes of said first arm and said second arm of said retaining plate, and said holes of each of said two contact arms of said plurality of contact arm arrangements; and said first arm and said second arm and said retaining plate form a substantially U-shaped retaining clip, said U-shaped retaining clip being disposed adjacent the two outermost ones of said plurality of contact arm arrangements to substantially enclose said plurality of contact arm arrangements;

said current limiting unit further comprises:

shaft means disposed on said upper side of said retaining plate;

means for attaching said shaft means to said retaining plate, said means for attaching said shaft means to said retaining plate comprises a substantially U-shaped retaining clip;

means for commonly attaching said retaining clip to said retaining plate and for attaching said plurality of brackets to said retaining clip;

said two contact arms of said plurality of contact arm arrangements are configured such that said two contact arms are pretensioned towards a corresponding one of said tabs disposed between said two contact arms;

said means for permitting displacement of said second end portion of said toggle arm means comprises a plurality of brackets each having a first side portion and a second side portion, said two lugs of ones of said plurality of toggle arm arrangements being disposed between said first side portions and said second side portions of corresponding ones of said plurality of brackets;

said plurality of brackets comprise a U-shape;

said first side portions and said second side portions of said plurality of brackets each have an elongated opening, said elongated openings of said first side portions and said second side portions being in substantial alignment with one another;

said elongated openings each having a first terminal portion and a second terminal portion, said first terminal portions being disposed adjacent ones of said plurality of springs and said second terminal portions being disposed a substantial distance from ones of said plurality of springs;

said toggle means further comprises:

a plurality of rods disposed substantially perpendicular to said two lugs of ones of said plurality of toggle arm arrangements, ones of said plurality of rods being fixedly attached to said second end portions of said two lugs;

ones of said plurality of rods each having end portions disposed a substantial distance from one another, said end portions of said plurality of rods being disposed in corresponding ones of said elongated openings of said first side portions and said second side portions of said plurality of brackets, to permit movement of said two lugs of ones of said plurality of toggle arm arrangements;

a plurality of slider portions fixedly attached to corresponding ones of said plurality of rods, said plurality of slider portions being radially displaceable with respect to said pin, the displacement of said plurality of slider portions being limited by the movement of said end portions of said rods within said elongated openings;

said at least one spring comprises a plurality of helical compression springs each having a first end and a second end, each of said first ends of ones of said plurality of springs being disposed about, and being supported by, at least a portion of corresponding ones of said plurality of slider portions;

said plurality of springs each being configured to bias said rods further towards said second terminal portions of said elongated openings in said first position of said toggle means upon wear of at least one of said first contact portion and said second contact portion, than in said first position of said toggle means when there is no wear of said at least one of said first contact portion and said second contact portion, to permit said plurality of contact arm arrangements to travel farther towards said first contact portion;

said retaining plate has an upper side and a lower side facing away from one another, said means for operatively attaching being disposed on said lower side;

said retaining plate comprises a plurality of supporting plates disposed substantially perpendicular to said retaining plate on said lower side of said retaining plate and at said second end portion of said retaining plate;

said plurality of supporting plates each comprising supporting pins disposed substantially parallel to said retaining plate, said second ends of said plurality of springs being disposed about, and being supported by, corresponding ones of said supporting pins;

said at least a portion of ones of said plurality of said slider portions about which said first ends of corresponding springs are disposed each comprise a pin portion, each of said pin portions having shoulders for supporting said first ends of said springs;

said toggle means being limited in its movement between said first position and said second position by the movement of said first contact portion;

said plurality of supporting plates and said plurality of said supporting pins are configured to be stamped out from said retaining plate, said plurality of supporting plates and said plurality of supporting pins being substantially integral with said retaining plate;

said toggle means being associated with at least one additional similar toggle means;

said second portion of said contact arm means is disposed at an angle with respect to said first portion of said contact arm means;

said pin comprises at least one disc spring disposed thereabout for biasing said two contact contact arms of said plurality of contact arm arrangements towards a corresponding one of said plurality of tabs; and said shaft means comprises a transverse selector shaft.

* * * * *

UNITED STATES PATENT AND TRADEMARK OFFICE

CERTIFICATE OF CORRECTION

PATENT NO. : 5,534,674

DATED : July 9, 1996

INVENTOR(S) : Wilhelm STEFFENS

It is certified that error appears in the above-indentified patent and that said Letters Patent is hereby corrected as shown below:

In column 2, line 6, after 'connector', delete "the complex means;" and insert --; the complex means--.

In column 2, line 7, after 'force', delete "the complex means; and" and insert --; and the complex means--.

Signed and Sealed this

Twenty-first Day of January, 1997

*Attest:*

BRUCE LEHMAN

*Attesting Officer*

*Commissioner of Patents and Trademarks*